US010436206B2

(12) United States Patent
Freeland et al.

(10) Patent No.: US 10,436,206 B2
(45) Date of Patent: Oct. 8, 2019

(54) WEARABLE DESK FAN HAVING A BASE TO FACILITATE SELECTIVE POSITIONING OF A FAN HOUSING TO PROVIDE VARIED AIR FLOW PATHS

(71) Applicants: Brian Freeland, Chandler, AZ (US); Robert Vasquez, Gilbert, AZ (US)

(72) Inventors: Brian Freeland, Chandler, AZ (US); Robert Vasquez, Gilbert, AZ (US)

(73) Assignee: SHAWSHANK LEDZ INC., Gilbert, AZ (US)

( * ) Notice: Subject to any disclaimer, the term of this patent is extended or adjusted under 35 U.S.C. 154(b) by 0 days.

(21) Appl. No.: 15/897,168

(22) Filed: Feb. 15, 2018

(65) Prior Publication Data

US 2018/0355875 A1 Dec. 13, 2018

Related U.S. Application Data

(60) Provisional application No. 62/517,199, filed on Jun. 9, 2017.

(51) Int. Cl.
*F04D 25/08* (2006.01)
*F04D 29/64* (2006.01)
(Continued)

(52) U.S. Cl.
CPC ..... *F04D 25/084* (2013.01); *F04D 25/0673* (2013.01); *F04D 29/601* (2013.01); *F04D 29/644* (2013.01)

(58) Field of Classification Search
CPC .. F04D 25/084; F04D 25/0673; F04D 29/601; F04D 29/644
(Continued)

(56) References Cited

U.S. PATENT DOCUMENTS 4,341,151 A * 7/1982 Sakamoto ..... F04D 25/08 248/166
5,146,765 A 9/1992 Waters
(Continued)

FOREIGN PATENT DOCUMENTS

WO 2005068846 A1 7/2005
WO 2007130381 A3 9/2008
WO 2016188410 A1 12/2016

OTHER PUBLICATIONS

"5-inch Portable USB Fan", by O2COOL, Found Online [Mar. 18, 2019] (p. 1) https://www.o2-cool.com/FD05003?page_id=843 (Year: 2016).*

(Continued)

*Primary Examiner* — David E Sosnowski
*Assistant Examiner* — Andrew Magd
(74) *Attorney, Agent, or Firm* — LegalForce RAPC Worldwide

(57) ABSTRACT

Disclosed are a method, a system, and a device to provide a wearable desk fan having a base to facilitate selective positioning of a fan housing to provide varied air flow paths to a user. In one aspect, the wearable desk fan includes a rotatable fan cage having a plurality of rotating blades to create a current of air, a mounting bracket to affix the rotatable fan cage at an end of plurality of wishbone arms, and a base handle coupled with the mounting bracket to allow folding of the base handle forming its base. A hinge joint and a beveled plate at the end of plurality of wishbone arms enable revolving and tilting of the rotatable fan cage. The mounting bracket may have a loop to attach a lanyard to enable hanging of the fan around a neck of the user.

20 Claims, 3 Drawing Sheets

(51) Int. Cl.
*F04D 25/06* (2006.01)
*F04D 29/60* (2006.01)

(58) Field of Classification Search
USPC ..... 415/126; 416/63; 62/259.3
See application file for complete search history.

(56) References Cited

U.S. PATENT DOCUMENTS 5,304,035 A 4/1994 Carter
6,155,782 A * 12/2000 Hsu ..... F04D 25/084 415/126
6,192,702 B1 2/2001 Shimogori
6,666,647 B1 12/2003 Trask
6,955,524 B2 10/2005 Stengel
7,828,524 B2 11/2010 Chen
9,205,218 B1 12/2015 Bachan et al.
D841,796 S * 2/2019 Freeland ..... D23/382
2004/0197199 A1* 10/2004 Cheng ..... F04D 25/084 417/234
2005/0000231 A1 1/2005 Lee
2007/0257383 A1 11/2007 Chan
2012/0269663 A1* 10/2012 Kamiya ..... F04D 25/0673 417/411
2013/0108481 A1 5/2013 Hoye
2016/0356279 A1* 12/2016 Xu ..... F04D 25/084
2018/0000014 A1 1/2018 Yamaoka et al.

OTHER PUBLICATIONS

"The World's Most Versatile Hands Free Rechargeable Cooling Fan", by Cool on the Go, Found Online [May 23, 2018] (pp. 4). https://www.coolonthego.com/.
"Deluxe Necklace Fan", by O2COOL, Found Online [May 23, 2018] (pp. 5) https://www.o2-cool.com/FN02001.

* cited by examiner

WEARABLE DESK FAN HAVING A BASE TO FACILITATE SELECTIVE POSITIONING OF A FAN HOUSING TO PROVIDE VARIED AIR FLOW PATHS

CLAIM OF PRIORITY

This non-provisional patent application is a conversion application of and claims priority to the U.S. Provisional Patent Application No. 62/517,199 titled "WEARABLE DESK FAN" filed on Jun. 9, 2017.

FIELD OF TECHNOLOGY

The present invention generally relates to portable electric fan, and more particularly, to a wearable desk fan having a base to facilitate selective positioning of a fan housing to provide varied air flow paths to the user.

BACKGROUND

A small size portable fan (e.g., an apparatus with rotating blades that creates a current of air for cooling and/or ventilation) may be powered by battery and/or electricity may be used to circulate air to enhance personal comfort. The portable fan may be used for personal cooling and may be designed for use at a fixed location. However, a stationary fan may not be readily used outdoor and/or when moving around (e.g., walking, playing, working, driving, etc.). Further, user with health ailments may require continuous source of cooling without restricting their movement. Hence, it would be desirable to have the benefit of a fan's cooling breeze even when moving.

Furthermore, the portable fan may not have a mechanism to adjust the angle of blower relatively to the body of the user. The portable fan may be tilted to certain fixed limits on a planar surface and may not be adjusted further. In the absence of proper mechanism to adjust the fan to a required angle, it may be inefficient in providing personal cooling to the user. The adjustment may further rely on the surface on which the fan is placed and may be limiting for using in different places.

SUMMARY

Disclosed are a method, a system, and a device to provide a wearable desk fan having a base to facilitate selective positioning of a fan housing to provide varied air flow paths to a user.

In one aspect, a multi-directional wearable cooling device includes a rotatable fan cage, a mounting bracket, and a base handle. The rotatable fan cage includes a plurality of rotating blades to create a current of air for cooling. The mounting bracket affixes the rotatable fan cage at an end of plurality of wishbone arms of the mounting bracket about a first horizontal axis. A hinge joint at the end of plurality of wishbone arms of the mounting bracket enables revolving of the rotatable fan cage around the first horizontal axis (e.g., 270 degree rotation about the first horizontal axis). A beveled plate at the end of plurality of wishbone arms of the mounting bracket allows tilting of the rotatable fan cage at a particular angle of rotation (e.g., at 5-10 degree interval up to 270 degree) about the first horizontal axis.

The beveled plate includes a locking system to enable the rotatable fan cage to be affixed at the particular angle about the first horizontal axis. The end of plurality of wishbone arms includes a loop to attach a lanyard to enable hanging of the multi-directional wearable cooling device around a neck of a user.

The base handle is coupled with a bottom edge of the mounting bracket. Further, the base handle includes a pivoting mechanism to allow folding of the base handle around a second horizontal axis. The base handle forms a base of the multi-directional wearable cooling device to place on a planar surface.

The plurality of rotating blades may remain flush with the base handle and/or non-protrusive of the rotatable fan cage when worn by the user. The multi-directional wearable cooling device may remain OFF when the rotatable fan cage is in flush position with the base handle when worn by the user. The multi-directional wearable cooling device may only be turned ON when an angle of rotation is at least 25 degrees about the first horizontal axis.

The rotatable fan cage may protect a wearer of the multi-directional wearable cooling device from getting hurt by the plurality of rotating blades even while wearing the multi-directional wearable cooling device around his neck. The pivoting mechanism may enable the base handle to fold such that the rotatable fan cage sits flush with the base handle forming a support. The multi-directional wearable cooling device may not turn ON even accidentally when the rotatable fan cage is in flush position with the base handle when worn by the user.

The locking system may enable blowing of air in a particular direction through a selective positioning of the rotatable fan cage by affixing the rotatable fan cage at a desired angle (e.g., from 0 to 270 degree rotation at 5-10 degree interval about the first horizontal axis). The selective positioning may be an upward rotation and/or a downward rotation around the first horizontal axis. The pivoting mechanism may enable the base handle to form the support for the multi-directional personal cooling device by a lying down, a bending backward, and/or a folding back of the base handle.

The base handle may include a battery housing to encapsulate a battery to run the multi-directional personal cooling device when not connected to a power supply. The base handle may include a USB port to insert a USB cable to power the multi-directional personal cooling device. A rotating mechanism may enable the user to position the multi-directional wearable cooling device relative to his body position. The rotating mechanism of the multi-directional wearable cooling device may enable creating varied airflow path for the user.

In another aspect, a method of a personal cooling system includes a blower pivotally mounted on a bracket, a rotating mechanism affixed at an edge of the bracket, a cord attached to a loop at the edge of the bracket, and a base handle. The blower includes a plurality of rotating blades to blow a current of air for personal cooling. The rotating mechanism affixed at an edge of the bracket adjusts an angle of the blower relative to a body portion of a user. The rotating mechanism includes a hinge joint, a beveled plate, and a locking system. The hinge joint at the edge of the bracket enables revolving of the blower by 270 degrees around a first horizontal axis. The beveled plate allows tilting of the blower at a particular angle of rotation (e.g., 270 degrees) about the first horizontal axis. The locking system enables the blower to be affixed at the particular angle about the first horizontal axis.

The cord attached to the loop at the edge of the bracket enables hanging of the personal cooling system to a neck of the user. The base handle coupled with a bottom edge of the bracket includes a pivoting mechanism to allow folding of the base handle around a second horizontal axis. The pivoting mechanism allows forming a base of the personal cooling system to place on a planar surface by folding the base handle.

In yet another aspect, a personal hanging fan includes a rotatable fan cage, a mounting bracket, and a base handle. The rotatable fan cage includes a plurality of rotating blades to create a current of air for cooling relative to a body portion of a user. The plurality of rotating blades remains flush with the base handle and/or non-protrusive of the rotatable fan cage when worn by the user. The mounting bracket affixes the rotatable fan cage at an end of plurality of wishbone arms of the mounting bracket about a first horizontal axis. The mounting bracket includes a hinge joint at the end of plurality of wishbone arms of the mounting bracket to enable revolving of the rotatable fan cage by 270 degrees around the first horizontal axis. The personal hanging fan only turns ON when an angle of rotation is at least 25 degrees about the first horizontal axis. The multi-directional wearable cooling device does not turn ON even accidentally when the rotatable fan cage is in flush position with the base handle when worn by the user.

The mounting bracket further includes a beveled plate at the end of plurality of wishbone arms of the mounting bracket. The beveled plate allows tilting of the rotatable fan cage at a particular angle of rotation (e.g., at 5-10 degree interval up to 270 degrees) about the first horizontal axis. The beveled plate includes a locking system to enable the rotatable fan cage to be affixed at the particular angle (e.g., at 5-10 degree interval) about the first horizontal axis. The end of plurality of wishbone arms includes a loop to attach a lanyard to enable hanging of the personal hanging fan around a neck of a user.

The base handle coupled with a bottom edge of the mounting bracket includes a pivoting mechanism. The pivoting mechanism allows folding of the base handle around a second horizontal axis. Folding of the base handle forms a base of the personal hanging fan to place on a planar surface.

In a further aspect, the portable fan may include a fan unit which is mounted either directly and/or through some type of joint on a base and/or a pedestal. The joint on the base and/or the pedestal may allow tilting movement backward and/or forward direction about a horizontal axis. Further, the joint on the base and/or the pedestal may allow oscillating and/or rotational movement about a vertical axis. The tilting movement in a forward direction may be limited to about a few degrees downward beyond the horizontal and any further tilting may cause the fan to topple over due to its center of gravity, making it unsafe for the user.

In one more aspect, present disclosure offers a wearable desk fan to provide a multi-directional cooling device that may be worn around the neck and/or placed on a planar surface to work as a rechargeable personal cooling system. The wearable desk fan may have a locking mechanism to fix the fan cage at a desirable angle.

The wearable desk fan may include a rotatable fan cage, a base handle, and a bracket. The fan cage of the wearable desk fan may be mounted on the bracket attached to the base handle of the fan. The fan cage of the wearable fan may keep all the moving parts of the fan inside the shell making it safe to use.

The wishbone shape of the bracket may have a hinge joint to support the fan cage. The hinge joint of the bracket may allow 270 degree rotation of the fan cage around its horizontal axis. The brackets may have beveled plates on its axis that allow tilting of fan cage at 10 degree intervals. The beveled plates may have a locking system to allow the fan to be fixed at a desirable angle and facilitate selective positioning of the fan cage. The selective positioning of the fan housing may provide varied air flow paths to the user.

The hinge joint of the bracket may allow the fan cage to be rotated and/or fixed at a downward angle while hanging around the neck. The downward rotation of the fan cage may allow the user to blow the smoke downward while smoking. In another embodiment, the downward rotation of the fan cage allows the user to direct cool breeze of air towards his legs and/or lower torso while sitting. Further, the user may be able to dry off his lower torso and/or wet clothes by aiming the fan cage in the downward direction even while hanging the wearable desk fan around his neck.

Further, the base handle of the fan may have a pivoting mechanism at the top which may allow the base handle to fold back forming a base for the fan to enable it to be placed on a flat surface. The base handle may have rods on the back side. The pivoting mechanism of the handle enables the fan to be kept on a desk in several different positions. For example, handle may be laid down behind it, the fan cage may sit on the joint of the handle when it has been bent backwards forming a base, and/or the fan bent over and laying on top of the handle itself providing for the fan to tilt to different positions and give different angles for airflow from the fan. The base handle of the wearable desk fan may have the adaptability and capacity to be laid down on a flat underlying surface for the purpose of expanding the usage and application of its use.

The base handle of the wearable desk fan may include a USB port to power the fan. The USB port of the wearable desk fan may be connected to an AC power supply to run the fan. A USB cable may be inserted into the USB port to plug into an AC power source to run the wearable desk fan. Further, the wearable fan may have a battery housing. The battery housing may include a regular power battery to run the fan when not connected to a power supply. The regular power battery of the fan may enable the user to run the fan at outdoor and even in power outage situations.

Furthermore, the edges of the bracket may have loops to attach a lanyard to enable hanging of fan from the neck of the user. The compact and convenient lanyard attachment may make use of wearable fan hands-free.

Other features will be apparent from the accompanying drawings and from the detailed description that follows.

BRIEF DESCRIPTION OF THE DRAWINGS

The embodiments of this invention are illustrated by way of example and not limited in the figures of the accompanying drawings, in which like references indicate similar elements and in which.

Figure 1:
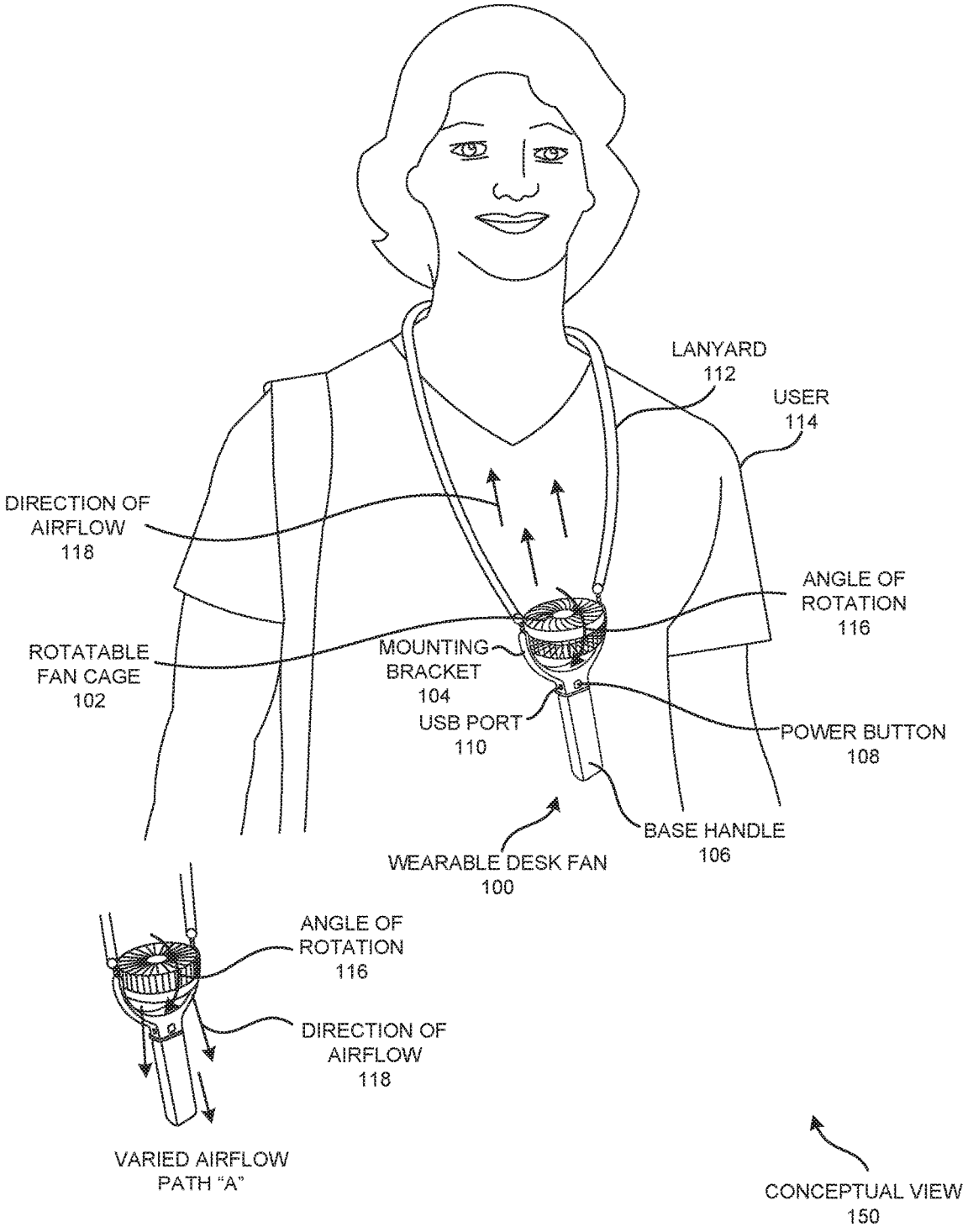
FIG. 1 is a conceptual view illustrating a user wearing a wearable desk fan around his neck using a lanyard attached to the loops of a mounting bracket of the wearable desk fan, according to one embodiment.

Other features of the present embodiments will be apparent from the accompanying drawings and from the disclosure that follows.

DETAILED DESCRIPTION

Disclosed are a method, a system, and a device to provide a wearable desk fan having a base to facilitate selective positioning of a fan housing to provide varied air flow paths to a user.

In one embodiment, a multi-directional wearable cooling device (e.g., wearable desk fan 100) includes a rotatable fan cage 102, a mounting bracket 104, and a base handle 106. The rotatable fan cage 102 includes a plurality of rotating blades to create a current of air (e.g., direction of airflow 118) for cooling. The mounting bracket 104 affixes the rotatable fan cage 102 at an end of plurality of wishbone arms 208 of the mounting bracket 104 about a first horizontal axis 202. A hinge joint 204 at the end of plurality of wishbone arms 208 of the mounting bracket 104 enables revolving of the rotatable fan cage 102 around the first horizontal axis 202. A beveled plate 206 at the end of plurality of wishbone arms 208 of the mounting bracket 104 allows tilting of the rotatable fan cage 102 at a particular angle of rotation 116 (e.g., at 5-10 degree interval up to 270 degrees) about the first horizontal axis 202.

The beveled plate 206 includes a locking system to enable the rotatable fan cage 102 to be affixed at the particular angle about the first horizontal axis 202. The end of plurality of wishbone arms 208 includes a loop to attach a lanyard 112 to enable hanging of the multi-directional wearable cooling device (e.g., wearable desk fan 100) around a neck of a user 114.

The base handle 106 is coupled with a bottom edge of the mounting bracket 104. Further, the base handle 106 includes a pivoting mechanism 302 to allow folding of the base handle 106 around a second horizontal axis 306. The base handle 106 forms a base of the multi-directional wearable cooling device (e.g., wearable desk fan 100) to place on a planar surface.

The plurality of rotating blades may remain flush with the base handle 106 and/or non-protrusive of the rotatable fan cage 102 when worn by the user 114. The multi-directional wearable cooling device (e.g., wearable desk fan 100) may remain OFF when the rotatable fan cage 102 is in flush position with the base handle 106 when worn by the user 114. The multi-directional wearable cooling device (e.g., wearable desk fan 100) may only be turned ON when an angle of rotation 116 is at least 25 degrees about the first horizontal axis 202.

The rotatable fan cage 102 may protect a wearer of the multi-directional wearable cooling device (e.g., wearable desk fan 100) from getting hurt by the plurality of rotating blades even while wearing the multi-directional wearable cooling device (e.g., wearable desk fan 100) around his neck. The pivoting mechanism 302 may enable the base handle 106 to fold such that the rotatable fan cage 102 sits flush with the base handle 106 forming a support. The multi-directional wearable cooling device (e.g., wearable desk fan 100) may not turn ON even accidentally when the rotatable fan cage 102 is in flush position with the base handle 106 when worn by the user 114.

The locking system may enable blowing of air in a particular direction through a selective positioning of the rotatable fan cage 102 by affixing the rotatable fan cage 102 at a desired angle. The selective positioning may be an upward rotation and/or a downward rotation around the first horizontal axis 202. The pivoting mechanism 302 may enable the base handle 106 to form the support for the multi-directional personal cooling device by a lying down, a bending backward, and/or a folding back of the base handle 106.

The base handle 106 may include a battery housing 210 to encapsulate a battery to run the multi-directional personal cooling device (e.g., wearable desk fan 100) when not connected to a power supply. The base handle 106 may include a USB port 110 to insert a USB cable to power the multi-directional personal cooling device (e.g., wearable desk fan 100). A rotating mechanism may enable the user 114 to position the multi-directional wearable cooling device (e.g., wearable desk fan 100) relative to his body position. The rotating mechanism of the multi-directional wearable cooling device (e.g., wearable desk fan 100) may enable creating varied airflow path (e.g., as shown in direction of airflow 118) for the user 114.

In another embodiment, a method of a personal cooling system (e.g., wearable desk fan 100) includes a blower pivotally mounted on a bracket (e.g., mounting bracket 104), a rotating mechanism (e.g., using pivoting mechanism 302) affixed at an edge of the bracket (e.g., mounting bracket 104), a cord (e.g., lanyard 112) attached to a loop at the edge of the bracket (e.g., mounting bracket 104), and a base handle 106. The blower (e.g., rotatable fan cage 102) includes a plurality of rotating blades to blow a current of air (e.g., direction of airflow 118) for personal cooling. The rotating mechanism (e.g., using pivoting mechanism 302) affixed at an edge of the bracket (e.g., mounting bracket 104) adjusts an angle of the blower (e.g., angle of rotation 116 at 5-10 degree interval up to 270 degrees) relative to a body portion of a user 114. The rotating mechanism (e.g., using pivoting mechanism 302) includes a hinge joint 204, a beveled plate 206, and a locking system. The hinge joint 204 at the edge of the bracket enables revolving of the blower (e.g., rotatable fan cage 102) around a first horizontal axis 202. The beveled plate 206 allows tilting of the blower (e.g., rotatable fan cage 102) at a particular angle of rotation 116 (e.g., at 5-10 degree interval up to 270 degrees) about the first horizontal axis 202. The locking system enables the blower to be affixed at the particular angle about the first horizontal axis 202.

The cord (e.g., lanyard 112) attached to the loop at the edge of the bracket (e.g., mounting bracket 104) enables hanging of the personal cooling system (e.g., wearable desk fan 100) to a neck of the user 114. The base handle 106 coupled with a bottom edge of the bracket includes a pivoting mechanism 302 to allow folding of the base handle 106 around a second horizontal axis 306. The pivoting mechanism 302 allows forming a base of the personal cooling system (e.g., wearable desk fan 100) to place on a planar surface by folding the base handle 106.

In yet another embodiment, a personal hanging fan (e.g., wearable desk fan 100) includes a rotatable fan cage 102, a mounting bracket 104, and a base handle 106. The rotatable fan cage 102 includes a plurality of rotating blades to create a current of air (e.g., direction of airflow 118) for cooling relative to a body portion of a user 114. The plurality of rotating blades remains flush with the base handle 106 and/or non-protrusive of the rotatable fan cage 102 when worn by the user 114. The mounting bracket 104 affixes the rotatable fan cage 102 at an end of plurality of wishbone arms 208 of the mounting bracket 104 about a first horizontal axis 202. The mounting bracket 104 includes a hinge joint 204 at the end of plurality of wishbone arms 208 of the mounting bracket 104 to enable revolving of the rotatable fan cage 102 around the first horizontal axis 202. The personal hanging fan (e.g., wearable desk fan 100) only turns ON when an angle of rotation 116 is at least 25 degrees about the first horizontal axis 202. The multi-directional wearable cooling device (e.g., wearable desk fan 100) does not turn ON even accidentally when the rotatable fan cage 102 is in flush position with the base handle 106 when worn by the user 114.

The mounting bracket 104 further includes a beveled plate 206 at the end of plurality of wishbone arms 208 of the mounting bracket 104. The beveled plate 206 allows tilting of the rotatable fan cage 102 at a particular angle of rotation 116 (e.g., at 5-10 degree interval up to 270 degrees) about the first horizontal axis 202. The beveled plate 206 includes a locking system to enable the rotatable fan cage 102 to be affixed at the particular angle about the first horizontal axis 202. The end of plurality of wishbone arms 208 includes a loop to attach a lanyard 112 to enable hanging of the personal hanging fan around a neck of a user 114. The base handle 106 coupled with a bottom edge of the mounting bracket 104 includes a pivoting mechanism 302 allows folding of the base handle 106 around a second horizontal axis 306. Folding of the base handle 106 enables to form a base of the personal hanging fan (e.g., wearable desk fan 100) to place on a planar surface. A USB cable may be inserted into the USB port 110 to power the personal hanging fan (e.g., wearable desk fan 100).

FIG. 1 is a conceptual view 150 illustrating a user 114 wearing a wearable desk fan 100 around his neck using a lanyard 112 attached to the loops of a mounting bracket 104 of the wearable desk fan 100, according to one embodiment. Particularly, FIG. 1 illustrates a wearable desk fan 100, a rotatable fan cage 102, a mounting bracket 104, a base handle 106, a power button 108, a USB port 110, a lanyard 112, a user 114, direction of airflow 116, and an angle of airflow 118, according to one embodiment.

The wearable desk fan 100 may be a cooling device with rotating blades to create a current of air to provide a multi-directional cooling that can be worn around the neck using a cord (e.g., lanyard 112) and/or placed on a planar surface (e.g., a desk). In an example embodiment, the wearable desk fan 100 may be a multi-directional wearable cooling device, a personal cooling system, and/or a personal hanging fan to provide a multi-directional cooling to a user wearing the wearable desk fan 100.

The rotatable fan cage 102 may be a metal and/or plastic casing inside which the fan blades rotate to allow the air flow in required direction. The mounting bracket 104 may be a wishbone shaped support for rotatable fan cage 102. The mounting bracket 104 may have a hinge joint 204 to allow rotation of rotatable fan cage 102 around the first horizontal axis 202, according to one embodiment.

The rotatable fan cage 102 of the wearable desk fan 100 may be tilted at 10 degree intervals (e.g., up to 270 degrees) around its horizontal axis (e.g., first horizontal axis 202) to be fixed at a desirable angle using the locking mechanism (e.g., a stopper) of the beveled plates 206. The locking mechanism (e.g., a stopper) of the beveled plates 206 may facilitate selective positioning of the rotatable fan cage 102. The selective positioning of the rotatable fan cage 102 may enable the user to change the direction of airflow 118 even in the downward direction as shown in the Varied Airflow Path "A" of FIG. 1. Further, the selective positioning of the rotatable fan cage 102 may provide varied air flow paths (e.g., downward direction of airflow 118) to the user, according to one embodiment.

The base handle 106 may be the lower part of the wearable desk fan 100 on which the rotatable fan cage 102 rests. The base handle 106 may be used to hold the wearable desk fan 100 in hand. The power button 108 may be a switch to turn ON the wearable desk fan 100. The USB port 110 may be a standard cable connection interface for charging the wearable desk fan 100. The USB port 110 may be connected to a power source to turn ON the wearable desk fan 100. The USB port 110 of the wearable desk fan 100 may be connected to a computer, and/or a car adapter to run the wearable desk fan 100, according to one embodiment.

The lanyard 112 may be a cord attached to the loops at edges of the mounting bracket 104 of the wearable desk fan 100. The lanyard 112 may enable hanging of wearable desk fan 100 from the neck of the user 114. The compact and convenient lanyard 112 attachment may make use of wearable desk fan 100 hands-free for the user 114, according to one embodiment.

Figure 2:
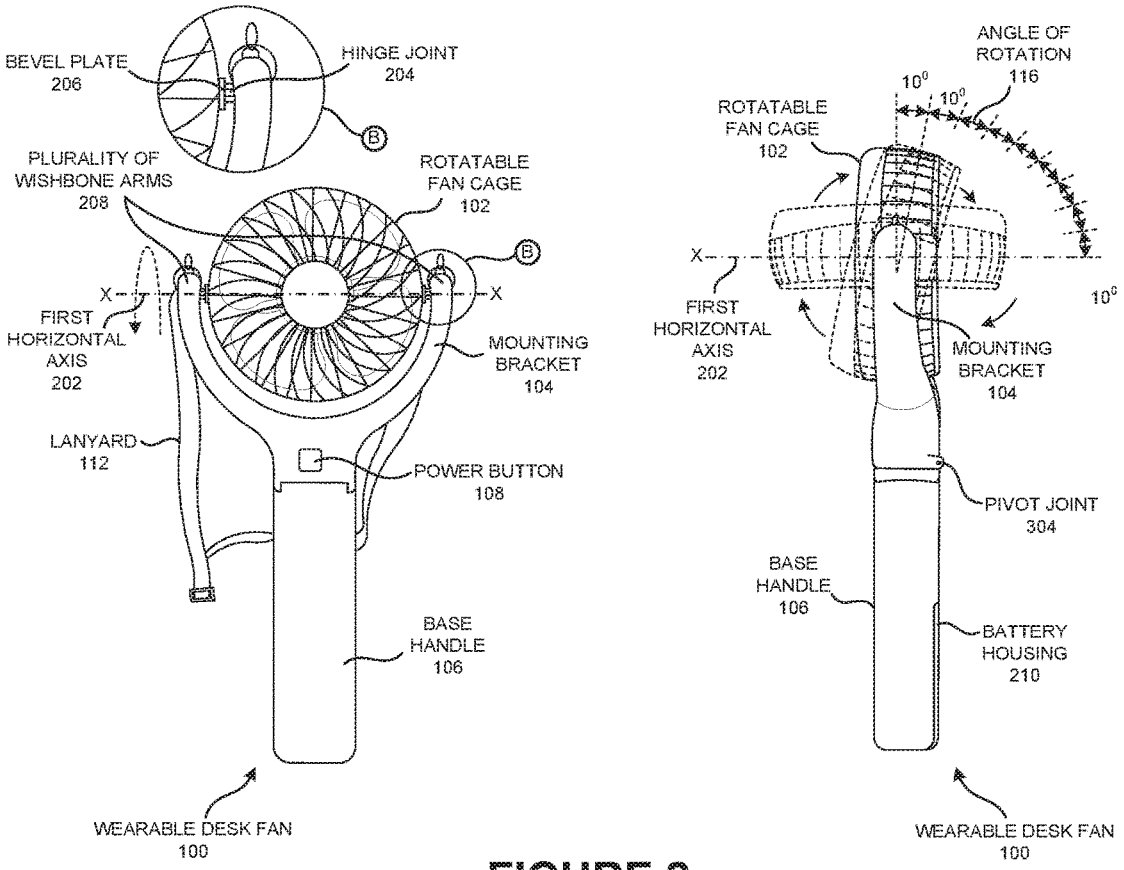
FIG. 2 is a schematic view of the wearable desk fan of FIG. 1 illustrating the tilting of a rotatable fan cage around its horizontal axis using the rotating mechanism of a base handle, according to one embodiment.

FIG. 2 is a schematic view of the wearable desk fan 100 of FIG. 1 illustrating the tilting of rotatable fan cage 102 around its horizontal axis using the rotating mechanism (e.g., shown in 'B') of the mounting bracket 104, according to one embodiment. Particularly, FIG. 2 builds on FIG. 1, and further adds, a first horizontal axis 202, a hinge joint 204, a bevel plate 206, plurality of wishbone arms 208, and a battery housing 210, according to one embodiment.

The first horizontal axis 202 may be a straight line through all fixed points of rotatable fan cage 102 around which all other points of the rotatable fan cage 102 move in circles. The rotatable fan cage 102 (e.g., fan housing) of the wearable desk fan 100 may be rotated around its horizontal axis (e.g., first horizontal axis 202, horizontal axis of rotation). The hinge joint 204 at the top end of the mounting bracket 104 may allow the rotatable fan cage 102 (e.g., fan housing) to be rotated to a desirable angle (e.g., angle of rotation 116 upto 270 degrees at 5-10 degree interval) around its axis of rotation (e.g., first horizontal axis 202). The bevel plate 206 may be a locking mechanism provided at the top end of the mounting bracket 104 to fix the rotatable fan cage 102 to a desired angle (e.g., at 10 degree interval) when rotated. The battery housing 210 may be a compartment and/or a chamber provided at the bottom portion of the base handle 106 to receive the battery to run the wearable desk fan 100 when not connected to a power source. The battery housing 210 may retain to protect the batteries, and may be sealed to prevent damage to the circuitry and/or components from battery leakage, according to one embodiment.

The plurality of wishbone arms 208 may be the forelimbs of the V-shaped mounting bracket 104 forming the support of the rotatable fan cage 102. The rotatable fan cage 102 is affixed at the plurality of wishbone arms 208 of the mounting bracket 104, according to one embodiment.

The rotating mechanism (e.g., shown in 'B') of the mounting bracket 104 may enable the user to rotate the rotatable fan cage 102 to any desired angle and adjust the angle of blower (e.g., angle of rotation 116 at 5-10 degree interval up to 270 degrees) relatively to his body even while moving, according to one embodiment.

Figure 3:
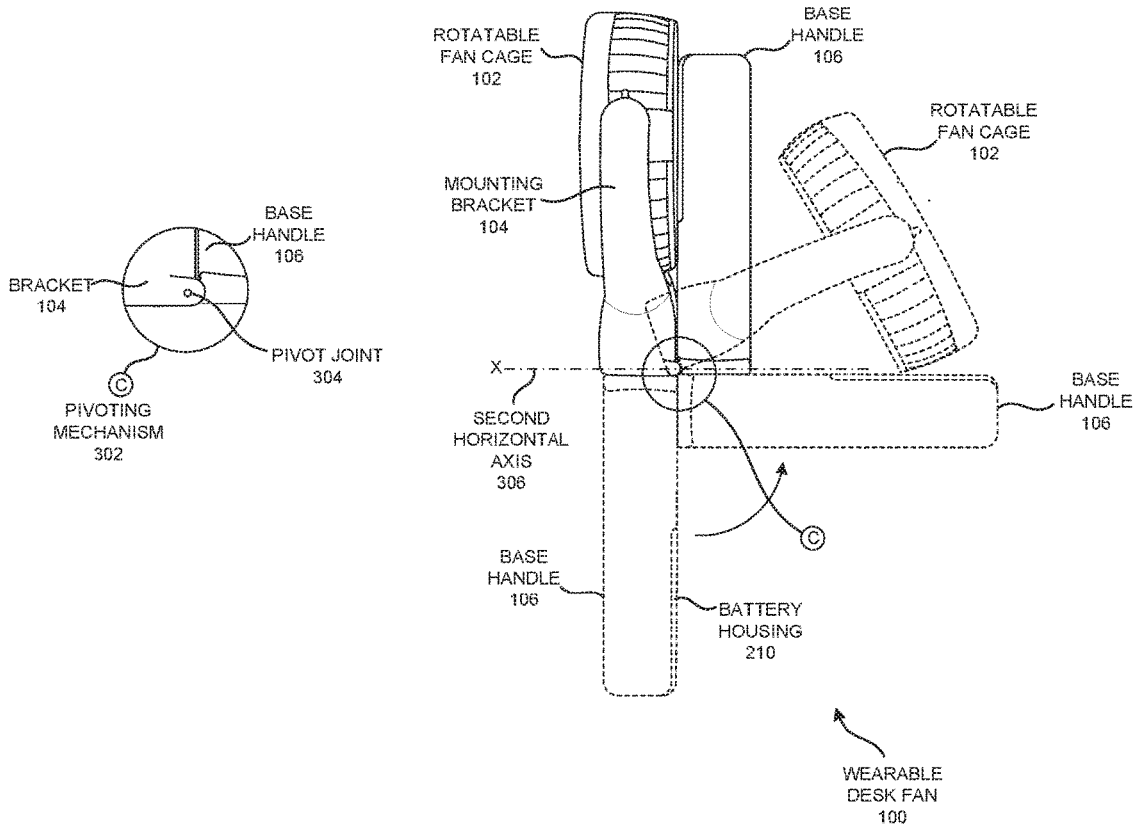
FIG. 3 is a schematic view of the wearable desk fan of FIG. 1 illustrating the pivoting mechanism of the base handle to position the wearable desk fan at a desirable position, according to one embodiment.

FIG. 3 is a schematic view of the wearable desk fan 100 of FIG. 1 illustrating the pivoting mechanism 302 (e.g., shown in 'C') of the base handle 106 to position the rotatable fan cage 102 at a desirable position, according to one embodiment. The pivoting mechanism 302 may include a short shaft (e.g., a pivot joint 304) at the end of base handle 106 on which the wearable desk fan 100 rests and/or turns about its second horizontal axis 306. The base handle 106 of the wearable desk fan 100 rotates and/or oscillates around the pivot joint 304 (e.g., center, second horizontal axis 306) of the pivoting mechanism 302. The pivoting mechanism 302 allows the wearable desk fan 100 to be rotated at a desired angle and form a base of the rotated base handle 106, according to one embodiment.

In yet another embodiment, a personal hanging fan (e.g., wearable desk fan 100) includes a rotatable fan cage 102, a mounting bracket 104, and a base handle 106. The rotatable fan cage 102 includes a plurality of rotating blades to create a current of air for cooling relative to a body portion of a user 114. The plurality of rotating blades remains flush with the base handle 106 and/or non-protrusive of the rotatable fan cage 102 when worn by the user 114. The mounting bracket 104 affixes the rotatable fan cage 102 at an end of plurality of wishbone arms 208 of the mounting bracket 104 about a first horizontal axis 202. The mounting bracket 104 includes a hinge joint 204 at the end of plurality of wishbone arms 208 of the mounting bracket 104 to enable revolving of the rotatable fan cage 102 around the first horizontal axis 202. The personal hanging fan (e.g., wearable desk fan 100) only turns ON when an angle of rotation 116 is at least 25 degrees about the first horizontal axis 202. The multi-directional wearable cooling device (e.g., wearable desk fan 100) does not turn ON even accidentally when the rotatable fan cage 102 is in flush position with the base handle 106 when worn by the user 114.

The mounting bracket 104 further includes a beveled plate 206 at the end of plurality of wishbone arms 208 of the mounting bracket 104. The beveled plate 206 allows tilting of the rotatable fan cage 102 at a particular angle of rotation 116 (e.g., at 5-10 degree interval up to 270 degrees) about the first horizontal axis 202. The beveled plate 206 includes a locking system to enable the rotatable fan cage 102 to be affixed at the particular angle about the first horizontal axis 202. The end of plurality of wishbone arms 208 includes a loop to attach a lanyard 112 to enable hanging of the personal hanging fan (e.g., wearable desk fan 100) around a neck of a user 114.

The base handle 106 coupled with a bottom edge of the mounting bracket 104 includes a pivoting mechanism 302. The pivoting mechanism 302 allows folding of the base handle 106 around a second horizontal axis 306. Folding of the base handle 106 forms a base of the personal hanging fan (e.g., wearable desk fan 100) to place on a planar surface. A USB cable may be inserted into the USB port 110 to power the personal hanging fan (e.g., wearable desk fan 100).

In a further embodiment, the portable fan (e.g., wearable desk fan 100) may include a fan unit which is mounted either directly and/or through some type of joint on a base and/or a pedestal (e.g., mounting bracket 104). The joint on the base and/or a pedestal may allow tilting movement backward and/or forward direction about a horizontal axis. Further, the joint on the base and/or a pedestal may allow oscillating and/or rotational movement of the portable fan about a vertical axis. The tilting movement in a forward direction may be limited to about a few degrees downward beyond the horizontal and any further tilting may cause the fan (e.g., wearable desk fan 100) to topple over due to its center of gravity, making it unsafe for the user 114.

In one more example embodiment, present disclosure offers a wearable desk fan 100 to provide a multi-directional cooling device that may be worn around the neck and/or placed on a planar surface to work as a rechargeable personal cooling system. The wearable desk fan 100 may have a locking mechanism to fix the fan cage (e.g., rotatable fan cage 102) at a desirable angle (e.g., angle of rotation 116 at 5-10 degree interval up to 270 degrees).

The wearable desk fan 100 may include a rotatable fan cage 102, a base handle 106, and a bracket. The fan cage of the wearable desk fan 100 may be mounted on the bracket (e.g., mounting bracket 104) attached to the base handle 106 of the fan. The fan cage (e.g., rotatable fan cage 102) of the wearable fan may keep all the moving parts of the fan inside the shell making it safe to use.

The wishbone shape of the bracket (e.g., mounting bracket 104) may have a hinge joint 204 to support the fan cage (e.g., rotatable fan cage 102). The hinge joint 204 of the bracket may allow the fan cage to be rotated around its horizontal axis (e.g., first horizontal axis 202) to about 270 degrees. The bracket (e.g., mounting bracket 104) may have beveled plates 206 on its axis that allows tilting of fan cage at 10 degree intervals. The beveled plates 206 may have a locking system to allow the fan to be fixed at a desirable angle (e.g., angle of rotation 116 at 5-10 degree interval up to 270 degrees) and facilitate selective positioning of the fan cage. The selective positioning of the fan housing (e.g., rotatable fan cage 102) may provide varied air flow paths to the user 114.

The hinge joint 204 of the bracket may allow the fan cage (e.g., rotatable fan cage 102) to be rotated and/or fixed at a downward angle while hanging around the neck. The downward rotation of the fan cage (e.g., rotatable fan cage 102) may allow the user 114 to blow the smoke downward while smoking. In another embodiment, the downward rotation of the fan cage (e.g., rotatable fan cage 102) allows the user 114 to direct cool breeze of air towards his legs and/or lower torso while sitting. Further, the user 114 may be able to dry off his lower torso and/or wet clothes by aiming the fan cage (e.g., rotatable fan cage 102) in the downward direction (e.g., as shown in direction of airflow 118) even while hanging the wearable desk fan 100 around his neck.

Further, the base handle 106 of the fan (e.g., wearable desk fan 100) may have a pivoting mechanism 302 at the top which may allow the base handle 106 to fold back forming a base for the fan to enable it to be placed on a flat surface. The base handle 106 may have rods on the back side. The pivoting mechanism 302 of the handle enables the fan to be kept on a desk in several different positions. For example, handle may be laid down behind it, the fan cage (e.g., rotatable fan cage 102) may sit on the joint of the handle when it has been bent backwards forming a base, and/or the fan (e.g., wearable desk fan 100) bent over and laying on top of the handle itself providing for the fan (e.g., wearable desk fan 100) to tilt to different positions and give different angles for airflow from the fan (e.g., wearable desk fan 100). The base handle 106 of the wearable desk fan 100 may have the adaptability and capacity to be laid down on a flat underlying surface for the purpose of expanding the usage and application of its use.

The base handle 106 of the wearable desk fan 100 may include a USB port 110 to power the wearable desk fan 100. The USB port 110 of the wearable desk fan 100 may be connected to an AC power supply to run the fan. A USB cable may be inserted into the USB port 110 to plug into an AC power source to run the wearable desk fan 100. Further, the wearable fan (e.g., wearable desk fan 100) may have a battery housing. The battery housing may include a regular power battery to run the fan (e.g., wearable desk fan 100) when not connected to a power supply. The regular power battery of the fan may enable the user 114 to run the fan (e.g., wearable desk fan 100) at outdoor and even in power outage situations.

Furthermore, the edges of the bracket may have loops to attach a lanyard 112 to enable hanging of fan (e.g., wearable desk fan 100) from the neck of the user 114. The compact and convenient lanyard 112 attachment may make use of wearable fan (e.g., wearable desk fan 100) hands-free.

An example embodiment will now be described. John Doe Cleaning Products may have recently started a small enterprise in New York City to deliver goods from different companies to his customers. John Doe, the CEO of John Doe Cleaning Products may need to collect goods from logistics department of suppliers and deliver these goods to the customers in different parts of New York City. John may be using his old refurbished truck to deliver the products to its customers. John may need to drive long distances to travel different parts of the city to deliver company products. The truck used by John may have a fan installed in his driver cabin which he may be unable to fix in required angle. In the absence of proper air circulation in his driver cabin, John may feel uncomfortable and uneasy while driving.

John Doe may have been gifted with a new wearable fan (e.g., wearable desk fan 100) as described in the various embodiments of FIGS. 1-3, by his teenage daughter Maria. John may have found this new fan very useful. John Doe may now be able to adjust the fan cage (e.g., rotatable fan cage 102) at a desired angle. The rotating mechanism (e.g., using hinge joint 204 of the wearable desk fan 100) of this new fan as described in the various embodiments of FIGS. 1-3 may enable John Doe to rotate the fan cage at different angles. Further, John may be able to place this new fan on the truck's dashboard in different angles using the pivoting mechanism 302 of the wearable desk fan 100 as described in the various embodiments of FIGS. 1-3 to enjoy varied air flow paths, according to one embodiment In addition, John may now be able to wear this new fan around his neck using a cord (e.g., lanyard 112) and get this new fan's cool breeze even when walking out of cabin, making him comfortable and happy, according to one embodiment.

A number of embodiments have been described. Nevertheless, it will be understood that various modifications may be made without departing from the spirit and scope of the claimed invention. In addition, the components depicted in the figures do not require the particular shape shown, to achieve desirable results. In addition, other components may be provided, and parts may be eliminated, and other components may be added to, or removed from, the described systems. Accordingly, other embodiments may within the scope of the following disclosure and/or claims.

Although the present embodiments have been described with reference to specific example embodiments, it will be evident that various modifications and changes may be made to these embodiments without departing from the broader spirit and scope of the various embodiments.

The invention claimed is:

1. A multi-directional wearable cooling device, comprising:

a rotatable fan cage comprising a plurality of rotating blades configured to create a current of air for cooling;

a mounting bracket configured to affix the rotatable fan cage at an end of a plurality of wishbone arms of the mounting bracket about a first horizontal axis comprising:

a hinge joint at the end of the plurality of wishbone arms of the mounting bracket configured to enable revolving of the rotatable fan cage around the first horizontal axis; and a beveled plate at the end of plurality of wishbone arms of the mounting bracket configured to allow tilting of the rotatable fan cage at a particular angle of rotation about the first horizontal axis, and to enable the rotatable fan cage to be affixed at the particular angle about the first horizontal axis, wherein the end of plurality of wishbone arms comprises a loop to attach a lanyard to enable hanging of the multi-directional wearable cooling device around a neck of a user; and a base handle coupled with a bottom edge of the mounting bracket configured to be able to fold around a second horizontal axis to form a base of the multi-directional wearable cooling device to place on a planar surface, wherein the multi-directional wearable cooling device is configured to remain OFF when the rotatable fan cage is in flush position with the base handle when worn by the user.

2. The multi-directional wearable cooling device of claim 1, wherein the plurality of rotating blades is configured to remain flush with the base handle and non-protrusive of the rotatable fan cage when worn by the user.

3. The multi-directional wearable cooling device of claim 1, wherein the multi-directional wearable cooling device is configured to only be turned ON when an angle of rotation is at least 25 degrees about the first horizontal axis.

4. The multi-directional wearable cooling device of claim 1, wherein the rotatable fan cage is configured to protect the user from getting hurt by the plurality of rotating blades even while wearing the multi-directional wearable cooling device around the neck thereof.

5. The multi-directional wearable cooling device of claim 1, wherein the base handle is configured to fold such that the rotatable fan cage sits flush with the base handle forming a support.

6. The multi-directional wearable cooling device of claim 1, wherein the multi-directional wearable cooling device is configured to not turn ON even accidentally when the rotatable fan cage is in the flush position with the base handle when worn by the user.

7. The multi-directional wearable cooling device of claim 1, wherein a selective positioning of the rotatable fan cage based on affixing the rotatable fan cage at a desired angle is configured to enable blowing of the air in a particular direction, wherein the selective positioning is at least one of: an upward rotation and a downward rotation around the first horizontal axis.

8. The multi-directional wearable cooling device of claim 1, wherein the base handle is configured to form a support for the multi-directional wearable cooling device by at least one of a lying down, a bending backward, and a folding back of the base handle.

9. The multi-directional wearable cooling device of claim 1, wherein the base handle comprises:

a battery housing configured to encapsulate a battery to run the multi-directional wearable cooling device when not connected to a power supply, and a USB port to insert a USB cable configured to power the multi-directional wearable cooling device.

10. A multi-directional wearable cooling device comprising:

a rotatable fan cage comprising a plurality of rotating blades configured to create a current of air for cooling;

a mounting bracket configured to affix the rotatable fan cage at an end of a plurality of wishbone arms of the mounting bracket about a first horizontal axis comprising:

a hinge joint at the end of the plurality of wishbone arms of the mounting bracket configured to enable revolving of the rotatable fan cage around the first horizontal axis; and a beveled plate at the end of plurality of wishbone arms of the mounting bracket configured to allow tilting of the rotatable fan cage at a particular angle of rotation about the first horizontal axis, and to enable the rotatable fan cage to be affixed at the particular angle about the first horizontal axis, wherein the end of plurality of wishbone arms comprises a loop to attach a lanyard to enable hanging of the multi-directional wearable cooling device around a neck of a user; and a base handle coupled with a bottom edge of the mounting bracket configured to be able to fold around a second horizontal axis to form a base of the multi-directional wearable cooling device to place on a planar surface, wherein the multi-directional wearable cooling device is configured to only be turned ON when an angle of rotation is at least 25 degrees about the first horizontal axis.

11. The multi-directional wearable cooling device of claim 10, wherein the plurality of rotating blades is configured to remain flush with the base handle and non-protrusive of the rotatable fan cage when worn by the user.

12. The multi-directional wearable cooling device of claim 10, wherein the multi-directional wearable cooling device is configured to remain OFF when the rotatable fan cage is in flush position with the base handle when worn by the user.

13. The multi-directional wearable cooling device of claim 10, wherein the base handle comprises:

a battery housing configured to encapsulate a battery to run the multi-directional wearable cooling device when not connected to a power supply.

14. A personal hanging fan comprising:

a rotatable fan cage comprising a plurality of rotating blades configured to create a current of air for cooling relative to a body portion of a user;

a mounting bracket configured to affix the rotatable fan cage at an end of a plurality of wishbone arms of the mounting bracket about a first horizontal axis comprising:

a hinge joint at the end of plurality of wishbone arms of the mounting bracket configured to enable revolving of the rotatable fan cage around the first horizontal axis; and a beveled plate at the end of plurality of wishbone arms of the mounting bracket configured to allow tilting of the rotatable fan cage at a particular angle of rotation about the first horizontal axis, and to enable the rotatable fan cage to be affixed at the particular angle about the first horizontal axis, wherein the end of plurality of wishbone arms comprises a loop to attach a lanyard to enable hanging of the personal hanging fan around a neck of a user; and a base handle coupled with a bottom edge of the mounting bracket configured to be able to fold around a second horizontal axis to form a base of the personal hanging fan to place on a planar surface, wherein the plurality of rotating blades is configured to remain flush with the base handle and non-protrusive of the rotatable fan cage when worn by the user, wherein the personal hanging fan is configured to only be turned ON when an angle of rotation is at least 25 degrees about the first horizontal axis, and wherein the personal hanging fan is configured to not turn ON even accidentally when the rotatable fan cage is in flush position with the base handle when worn by the user.

15. The personal hanging fan of claim 14, wherein a selective positioning of the rotatable fan cage based on affixing the rotatable fan cage at a desired angle is configured to enable blowing of the air in a particular direction, wherein the selective positioning is at least one of: an upward rotation and a downward rotation around the first horizontal axis.

16. The personal hanging fan of claim 14, wherein the base handle is configured to form a support for the personal hanging fan by at least one of a lying down, a bending backward, and a folding back of the base handle.

17. The personal hanging fan of claim 14, wherein the base handle comprises:

a battery housing configured to encapsulate a battery to run the personal hanging fan when not connected to a power supply, and a USB port to insert a USB cable configured to power the personal hanging fan.

18. The multi-directional wearable cooling device of claim 13, wherein the base handle further comprises a USB port to insert a USB cable configured to power the multi-directional wearable cooling device.

19. The multi-directional wearable cooling device of claim 10, wherein the base handle is configured to fold such that the rotatable fan cage sits flush with the base handle forming a support.

20. The multi-directional wearable cooling device of claim 10, wherein a selective positioning of the rotatable fan cage based on affixing the rotatable fan cage at a desired angle is configured to enable blowing of the air in a particular direction, the selective positioning being at least one of: an upward rotation and a downward rotation around the first horizontal axis.

* * * * *